United States Patent [19]

Parker

[11] Patent Number: 4,534,591

[45] Date of Patent: Aug. 13, 1985

[54] CONTROLLED ROCKING ACTION FURNITURE

[76] Inventor: Michael S. Parker, Rte. 185, Sorrento, Me. 04677

[21] Appl. No.: 433,905

[22] Filed: Oct. 12, 1982

[51] Int. Cl.[3] ..... A47C 3/02

[52] U.S. Cl. ..... 297/270; 297/310

[58] Field of Search ..... 297/310, 131, 270; 272/144

[56] References Cited

U.S. PATENT DOCUMENTS

| | | | |
|---|---|---|---|
| 667,085 | 1/1901 | Grader | 297/270 X |
| 1,138,270 | 5/1915 | Ziegler et al. | 297/270 |
| 1,421,260 | 6/1922 | Kurnick | 297/131 |
| 2,269,834 | 1/1942 | Wagner | 297/270 X |
| 2,325,716 | 8/1943 | Streit | 297/270 X |
| 4,367,870 | 1/1983 | Birch | 297/270 X |

*Primary Examiner*—James T. McCall

*Attorney, Agent, or Firm*—Daniel H. Kane, Jr.

[57] ABSTRACT

Controlled rocking action furniture such as a rocking chair is formed with curved side frame pieces for rocking engagement with the ground. Each curved side frame piece comprises a major smooth curved portion in turn composed of at least three component arcs of curvature of increasing radius. A seat frame joins the curved side frame pieces and defines an operating space near the base of the furniture. An upright stop mechanism is housed in the operating space and includes extendable and retractable legs which may be extended and retracted between a position substantially within the operating space and a position extending outside the seat frame in contact with the ground for stopping the chair in upright position. The side frame pieces are formed with first and second minor reverse curved portions at each end of the major curved portion providing forward and backward rocking stops. The rocking action may be designed over a wide angle of rotation for therapeutic application in orthopedic recliners and rockers generally.

17 Claims, 9 Drawing Figures

CONTROLLED ROCKING ACTION FURNITURE

TECHNICAL FIELD

This invention relates to rockable furniture or rocking action furniture and to mechanisms and arrangements for controlling or moderating the rocking action of the furniture. The invention is applicable, for example, to orthopedic recliners and adult furniture generally as well as for children's furniture of the type, for example, used to promote motor development.

BACKGROUND ART

U.S. Pat. No. 4,241,949 issued to the inventor describes a novel development in rockable furniture in which the side frame pieces for rocking engagement with the ground are formed by a major smooth curved portion composed of at least three component arcs of curvature of increasing radius. The component arcs which form the continuous major curve of the side pieces are arranged with the curvature radius increasing from the base of the curved side pieces to the top. As a result of the increasing radius, the sharpness of the curvature decreases from the base to the top of the curved side pieces so that rocking motion is damped or slowed in the backward rocking direction. A feature and advantage of the rockable furniture invention described in U.S. Pat. No. 4,241,949 is that while a small shift in weight or center of gravity may produce rocking or rotation through a large angle, the motion in the backwards direction is safely slowed and in fact can be brought to a halt according to the selection of component arcs. As described in U.S. Pat. No. 4,241,949 rocking action through a total angle of rotation of 125° is provided with a dramatic slowing to a halt at the back of the rock as a result of the decreasing curvature and increasing radius of the component arcs comprising the rocking curves.

A further control on the rocking action described in U.S. Pat. No. 4,241,949 is the provision of a slight or minor reverse curvature at the top of the curved side pieces forming an "ear" or back rocking stop which safely stops backward rocking motion beyond the reverse curved portion.

The present inventor has discovered that the rockable furniture invention described in U.S. Pat. No. 4,241,949 has valuable application in the medical field for orthopedic recliners and health related applications. The invention is also applicable in adult furniture generally. In these applications further control over the rocking action of the rockable furniture is desirable.

OBJECTS OF THE INVENTION

It is therefore an object of the present invention to provide rocking action furniture with an upright stop mechanism for locking the furniture in forward upright position.

Another object of the invention is to provide rocking action furniture with a forward rocking stop arrangement to prevent the chair from falling forward during rocking motion in the forward direction.

A further object of the invention is to provide novel arrangements for stopping backward rocking motion of the rockable furniture at a desired point in the backward rocking motion and rotation.

Yet another object of the invention is to provide rocking action furniture with stop mechanisms for stopping and locking the rockable furniture in a variety of upright attitudes.

DISCLOSURE OF THE INVENTION

In order to accomplish these results, the invention provides for rocking action furniture made with curved side pieces for rocking engagement with the ground. Seat frame pieces space and join the curved side pieces and the seat frame panels define an inner operating space near the base of the furniture. According to the invention an upright stop mechanism is housed in this inner operating space. A pivoting axle extends across the operating space defined by the seat frame panels and is supported at respective ends by the curved side pieces of the frame. A handle is provided for rotating the pivoting axle. Cams or eccentric mounting arms in the form of, for example, yokes extend from the pivoting axle inside the operating space. At least one elongate leg is pivotally mounted at one end to the cam or yoke. As a result upon rotation of the pivoting axle and extending eccentric mounting arm or cam, each leg pivots and translates thereby extending and retracting through a slot between a position substantially within the inner operating space and a position extending outside the seat frame in contact with the ground. A feature and advantage of this arrangement is that the rocking action furniture such as a rockable chair may be maintained in upright position. A locking arrangment is provided for locking the leg in extended position for stopping the rocking action of the furniture and maintaining the furniture in upright position.

In the preferred embodiment a pair of elongate curved legs are provided each having a major curve extending concave upward (convex downward) so that the leg may be drawn smoothly through the respective slots formed in the seat frame bearing against the edge of the slot upon rotation of the pivoting axle. Each leg stop may also be provided with a slight reverse curvature at the free end of the leg concave downward relative to the major curve of the leg, facilitating stable contact with the ground by the end of the leg when the leg is in extended position and the furniture in upright position.

In order to provide the locking action for locking the rockable furniture in a desired upright position, each leg is formed with at least one flat locking shelf on the concave upward major curve of the leg and the flat shelf is formed with an angle substantially complementary to a portion of the seat frame comprising an edge of the slot. A feature and advantage of this arrangement is that a portion of the weight of the furniture is directed onto the locking shelf pushing downward, for example, on the top side of the leg and locking the leg in place by the jamming or wedging action of the weight of the chair bearing through an edge of the slot onto the locking shelf. A further advantage of this arrangement is that the downward force of the weight of the furniture is transmitted to the pivoting axle which may be a steel rod, through the cam or eccentric mounting arm and leg. The rocking action furniture such as the rockable chair is thereby maintained in upright position. Each leg may be formed with a plurality of locking shelves for locking the rockable furniture in a plurality of upright positions of different attitudes.

Another feature of the elongate locking legs of smooth curvature is that the legs are formed with a protruding hammerhead at the pivotal end of the leg. The protruding hammerhead is constructed and arranged for bearing of the head against the seat frame for pushing the locking shelf against the edge of one side of the slot for wedging or jamming action when the leg is extended thereby supporting the weight of the furniture and stopping the furniture in an upright position.

According to one example of the construction of the furniture frame, the seat frame comprises a back panel, a seat panel substantially at right angles to the back panel and a reclining panel joining the back panel and seat panel with an acute angles between the reclining panel and the other panels. The seat frame panels thereby define an inner operating space of substantially triangular cross section. The slots for the upright stop mechanism are formed in the seat panel adjacent the junction with the back panel so that the bottom of the back panel defines one edge of the slots.

In the preferred example, locking shelves are formed on the upper surface of the pair of leg stops and the locking shelves are formed at substantially right angles to the back panel defining the edge of the slots. As a result, the weight of the furniture is directed in part through the back panel onto the locking shelves of the leg stops pushing downward on the locking shelves and jamming, wedging, and thereby locking the legs in place against the ground, the axle, and the opposite edge of the slots.

Further controls over the rocking action of the furniture are provided by the invention as follows.

A first minor reverse curve concave downward at the forward end of the major curve of each side piece provides a forward rocking stop to prevent the furniture from falling forward. To provide a backward rocking stop, the seat frame includes an upholstered portion formed over the back of the seat protruding beyond the curved side pieces. This upholstered portion thereby effectively forms a second minor reverse curvature at the upper end of the major curve of the side pieces and effectively stops backward rocking motion of the chair when the reverse curvature upholstered portion contacts the ground.

For control of the upright stop mechanism by a person using the chair or other rocking action furniture, the invention contemplates that the pivoting axle extends through one of the side pieces and is provided with a crank handle at the end of the axle. The person sitting in the chair or other furniture may therefore operate the upright stop mechanism from sitting position by reaching over and operating the crank action handle at the side of one of the curved side frame pieces.

Other objects, features, and advantages of the invention will become apparent in the following specification and accompanying drawings.

DESCRIPTION OF PREFERRED EXAMPLE EMBODIMENTS AND BEST MODE OF THE INVENTION

Figure 1:
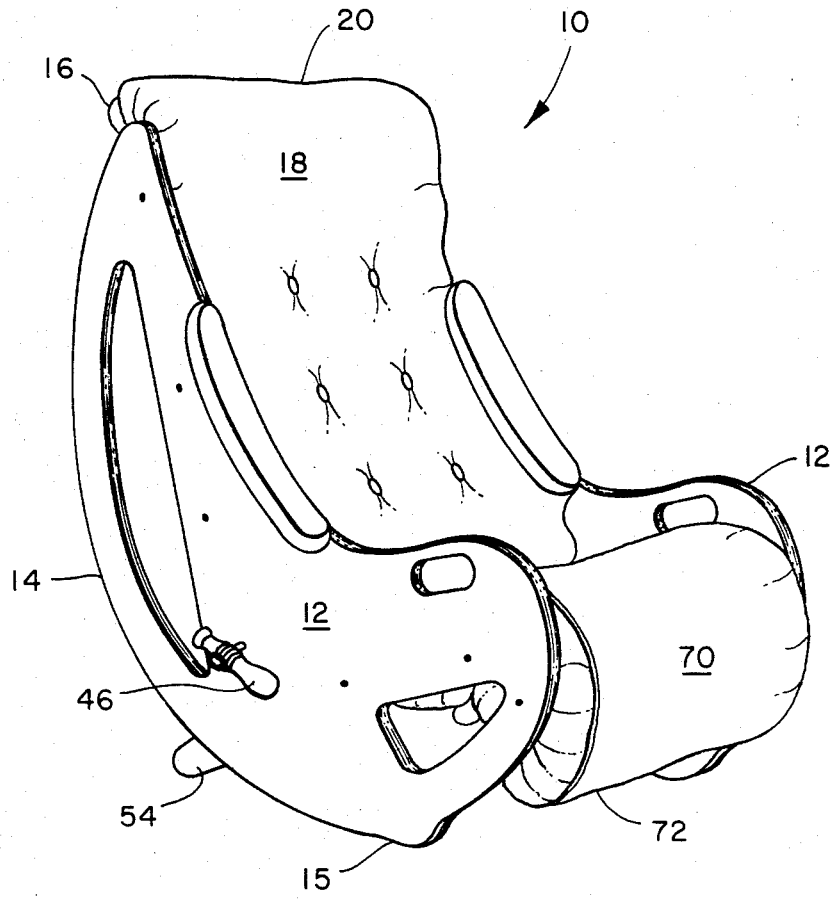
FIG. 1 is a line perspective view of a rockable chair with upright stop mechanisms in accordance with the present invention.
Figure 2A:
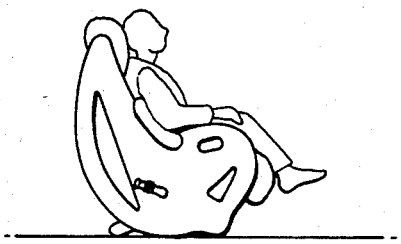
FIGS. 2A, 2B, 2C and 2D are a sequence of side views showing rocking action of the furniture according to the present invention through a rocking angle of rotation greater than 90° and, for example, up to 125°, yet with control of rocking action as hereafter described.
Figure 2B:
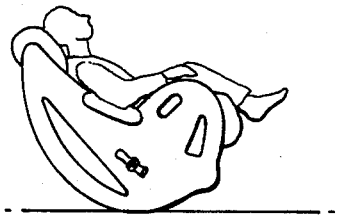
Figure 2C:
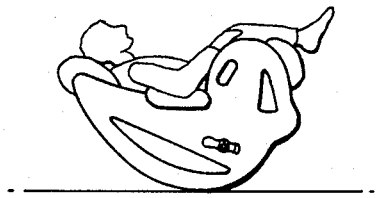
Figure 2D:
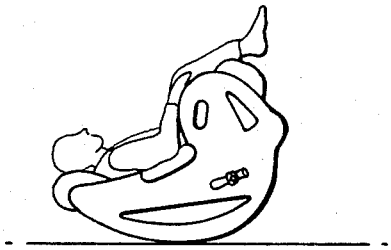
Figure 3:
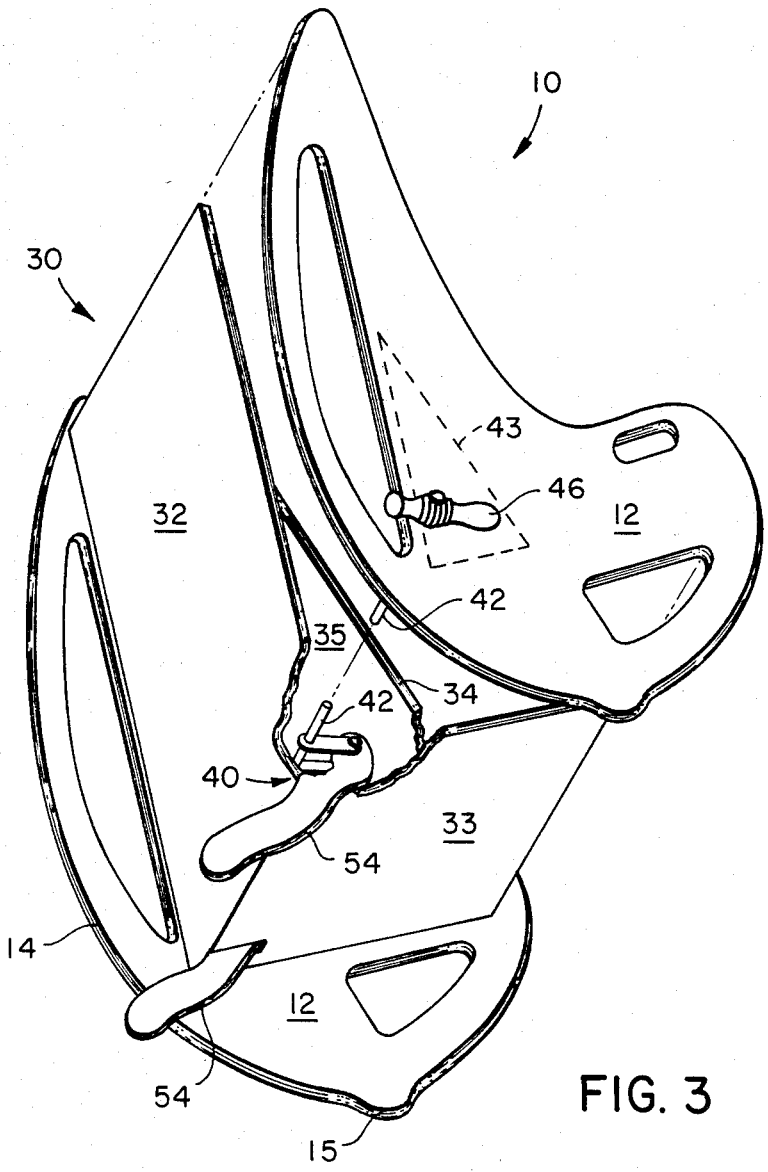
FIG. 3 is an exploded perspective view of the chair from a bottom perspective showing the slots in the seat frame and upright stop mechanism.

A rocking action chair 10 according to the present invention suitable for use, for example, as an orthopedic recliner, or more generally, an adult rocking chair, is shown in FIGS. 1-3. The chair 10 is formed by a pair of curved side frame pieces 12 having a major curved portion 14 oriented concave upward (convex downward) for rocking engagement with the ground. As described in U.S. Pat. No. 4,241,949, the major curved portion 14 is composed of three component arcs of differing radius of curvature. The component arcs are arranged with increasing radius of curvature from the bottom of the major curved portion 14 to the top so that the steepness of curvature decreases from the bottom to the top of the major curved portion. As a result, the rocking action of the furniture is damped or slowed as the chair is rocked in the backward direction. As is readily apparent in the Figures, the side frame pieces 12 are constructed and arranged with features convenient to the occupant of the chair such as hand grips, etc.

While the increasing radius of curvature and decreasing curvature from bottom to top slows the backward rock, a reverse curved portion 15 is provided at the bottom and forward end of the major curved portion 14 to provide a stop in the forward rocking direction. Thus, the minor reverse curve 15 oriented concave downward (convex upward) serves to stop the rocking motion in the forward direction and prevent the chair from falling forward.

A second minor reverse curvature or curved portion 16 is also effectively provided at the top of the major curved portion 14 by the upholstery 18 of chair 10. The upholstery 18 for chair 10 includes an upper upholstered portion 20 folded over the back of the chair which effectively provides the second minor reverse curve 16. Upper upholstered portion 20 therefore provides a backstop which completely stops rocking motion in the backwards direction.

Thus, the graduated component arcs of the major curved portion 14, the first minor reverse curvature 15 at the front and bottom of the major curved portion 14, and the second minor reverse curvature 16 at the top and backward end of major curved portion 14 serve to effectively and safely control the rocking action of chair 10. The major curved portion 14 dampens and slows rocking action in the backwards direction while the minor curved portions 15 and 16 provide boundary stops to the rocking motion in both the forward and backwards direction preventing the chair from falling forward or backward beyond the design locations of the reverse curvatures. The angle of rotation of the rock between the front stop and back stop boundaries formed by the minor reverse curved portions can be selected to be, for example, up to 125° for therapeutic applications as an orthopedic recliner, all as shown in FIGS. 2A, 2B, 2C, and 2D.

As shown in FIG. 3, the curved side frame pieces 12 are joined together by a seat frame portion 30. Seat frame portion 30 is composed of a back panel 32, a seat panel 33, and an inclined panel 34 which joins the back panel 32 and seat panel 33 at acute angles. Thus, the back panel 32, seat panel 33, and inclined or reclining panel 34 are joined together and define an inner space or operating space 35 of triangular cross-sectional configuration. Within this inner space or operating space 35 is housed the upright stop mechanism 40 according to the invention.

Figure 4A:
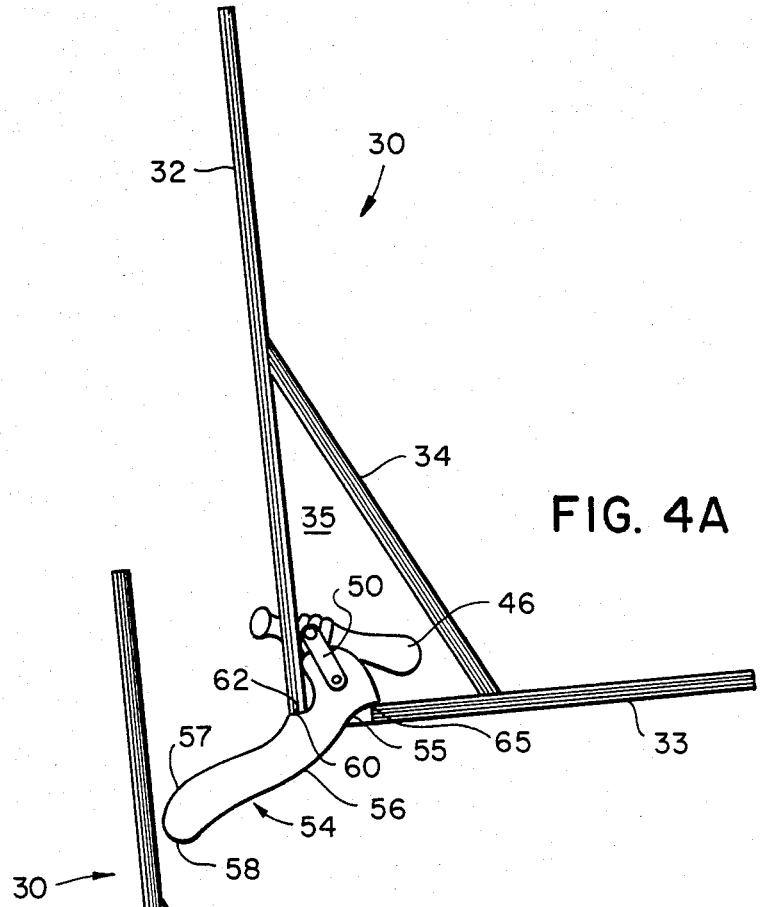
FIG. 4A is a plan view of an elongate leg of the upright stop mechanism in the operating space and in extended position.
Figure 4B:
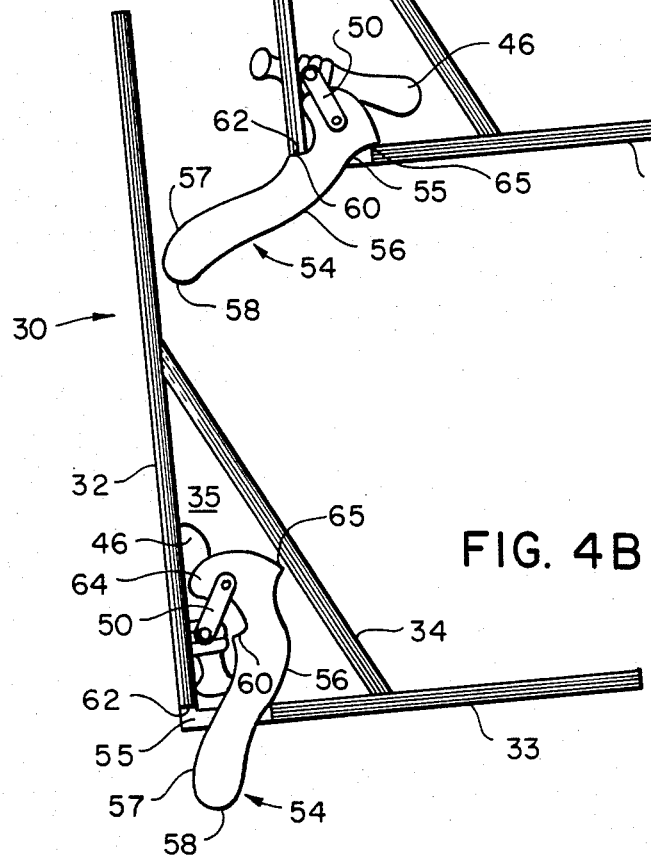
FIG. 4B is a plan view of a leg of the upright stop mechanism in the operating space and in retracted position.
Figure 5:
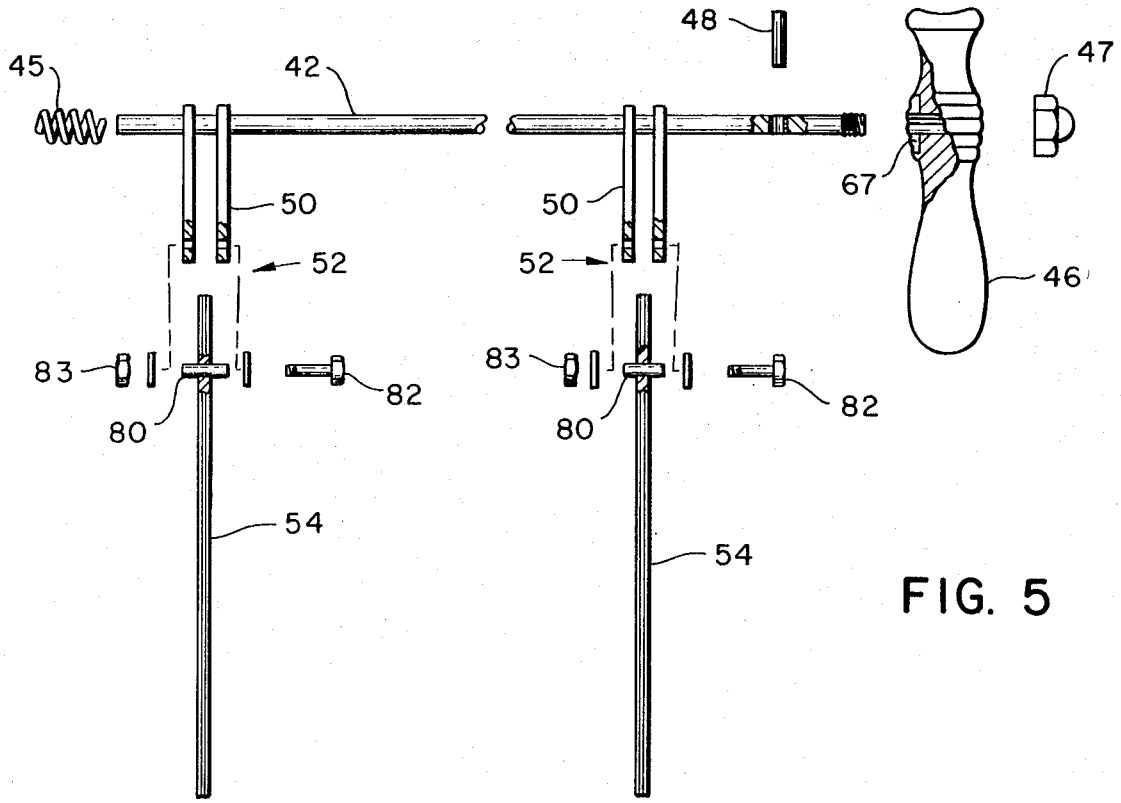
FIG. 5 is a plan view of the upright stop mechanism showing the pivoting axle or rod, yokes, crank handle and spring in exploded form.

Referring to FIGS. 3-5, the upright stop mechanism 40 includes a rotating or pivoting axle 42 which extends across the operating space 35 and is supported at each end by the curved side pieces 12 through side reinforcements 43. On the far side of FIG. 3 the end of the pivoting axle 42 is seated in a hole not shown formed in a reinforcing piece 43 fixed to the curved side piece 12. The axle 42 passes through a spring 45 at the seating hole. Spring 45 spring loads the axle 42 so that the pivot remains in place at any angular or rotational position to which it is set by means of the handle 46. The near side of axle 42 passes entirely through the near curved side piece 12 and reinforcing piece and the handle 46 is attached to axle 42 outside the curved side piece 12 as shown in FIG. 1. Handle 46 is held in place on the axle rod 42 by means of a threaded nut 47 and a locking pin 48 which is seated in a recess 67 in the side of the handle 46 when the handle is tightened in place by the nut 47. The handle 46 is formed as a crank handle with a longer extension on one side of axle 42 than on the other.

The pivoting axis or angle 42 is provided with a pair of cams or eccentric mounting arms 50 each in the form of an extending yoke with the pivot point 52 at the end of each cam yoke. Suspended from the pivot point 52 of each yoke is an elongate leg 54 suitable for extension and retraction through the slots 55 formed in the seat panel 33 of the seat frame portion 30.

As shown in more detail in FIGS. 4A and 4B, each of the legs 54 includes a major curved portion 56 having a concave upward (convex downward) orientation and terminating at the free end or lower end in a minor reverse curvature or reverse curved portion 57. The end or tip 58 of the leg is thereby directed into the ground for stable contact when the leg is extended and the chair is in the upright position. The concave side or upper side of the major curved portion 56 of leg 54 is provided with a locking shelf or ledge 60 oriented so that the ledge 60 is approximately at right angles to the back panel 32 of seat frame 30 when the chair is in upright position and leg 54 extended. As a result of this configuration as hereafter described, the bottom edge 62 of back shelf 32 therefore rests on the locking shelves or ledges 60 of the legs 54 when the chair is locked in upright position.

At the pivot end or upper end of each of the legs 54, the legs terminate in a hammerhead 64 and a jamming edge 65 whose functions can be seen with reference to FIGS. 4A and 4B. Upon rotation of crank handle 46 and pivoting axle 42, the legs 54 pivot on the cam yoke pivots 52 and translate through slots 55 until the hammerhead 64 engages and presses against the back panel 32 urging the locking edge or shelf 60 against the bottom edge 62 of back panel 32. At the same time the jamming edge 65 rests against the seat panel 33 at the opposite ends of slots 55. The extended position and locking position of the upright stop mechanism for locking the chair in upright position is shown in FIG. 4A. In other words, the yokes 50 provide an eccentric pivotal mounting for the elongate legs 54 relative to the pivoting axis or axle 42 resulting in both pivotal motion and lateral translation of the legs 54 upon rotation of the pivoting axis 42 by means of handle 46.

Upon rotation of the handle 46 180° the pivot axle 42 and cam yokes or eccentric mounting yokes 50 rotate and legs 54 pivot on the cam yoke pivot points 52 and translate retracting through slots 55 to the retracted position shown in FIG. 4B. It is thus apparent that the particular shape and configuration of the legs 54 perform a variety of functions in operative combination with the other elements of the upright stop mechanism. The major smooth curvature portion 56 facilitates smooth sliding of the leg through slot 55 while the minor reverse curved portion 57 directs the free end 58 of leg 54 into the ground for stability. The locking shelf or ledge 60 permits at least a portion of the weight of the chair directed through back panel 32 to rest upon the legs 54 and the force of the chair is thereby translated to the pivoting axle 52. At the upper end of leg 54 the hammerhead 64 operatively pressing against back panel 32 of the seat frame 30 pushes the leg and, in particular, the shelf or ledge 60 beneath the bottom edge 62 of back panel 32 defining one end of the slot 55. The weight of the chair directed on ledge or shelf 60 is transferred to the pivoting axle 52, which axle is able to bear the weight of the chair. However, optionally the jamming edge 65 resting against the seat panel 33 also may bear some of the weight through a wedging or jamming action. It is apparent, however, that the jamming edge 65 may be omitted in which case all the weight translated down the back of chair through panel 32, is thereby transferred to the pivoting axis or axle 52.

The elements of the upright stop mechanism are also shown in the plan view of FIG. 5. In this illustration, the handle portion is exploded showing the lock nut 47 which retains the handle 46 on axle 42 when the nut is secured to the threaded end 66 of the axle 42. So that the crank handle 46 will not slip relative to the rod 42, a locking pin 48 passing through a hole drilled in the axle or rod 42 sits within a recess 67 formed in the side of the handle for locking the handle against the pin 48. By this expedient, crank handle 46 and pivoting axle rod 42 move as a unit so that the legs 54 pivot and translate extending and retracting through slots 55 upon rotation of crank handle 46 through 180°.

The legs 54 are suspended from the cam yokes or eccentric mounting yokes 50 at pivot points 52 on bushings 80 through which pass the bolts 82 and nuts 83 for securing the legs to the yokes.

It is apparent that legs 54 may be provided with a plurality of locking shelves or ledges 60 for stopping the chair 10 in a number of upright positions and locking the chair in a number of attitudes. It is also apparent that a variety of seat frame configurations may be utilized for joining the curved side frame pieces provided the seat frame defines an operating space, not necessarily enclosed, within which the upright stop mechanism may be recessed or housed. The operating space or area for the mechanism may be defined by the type of construction and material used for the frame pieces. For example, the entire chair or other rockable furniture, including the curved side pieces and seat frame may be made of "bentwood" or bent tubular frame pieces of appropriate materials such as wood, plastic or metal. Furthermore, the seat frame may incorporate canvas sling material, caning, rattan, etc. Furthermore, slot defining means or guides of a variety of configurations may be provided for guiding the extending and retracting legs and for delivering the weight of the chair onto a locking shelf or ledge of the legs 54 according to the type of construction and material used for the chair frame pieces.

A further feature of the rockable chair shown in FIG. 1 is the leg rest. Such a leg rest is formed by securing a depending panel 70 from the front edge of the seat panel 33 of seat frame 30. This depending panel 70 is then covered over with the upholstery 18 forming the folded upholstered portion 72.

While the invention has been described with reference to particular example embodiments, it will be apparent that it is intended to cover all modifications and equivalents within the scope of the following claims.

I claim:

1. Rocking action furniture with upright stop mechanism comprising:

curved side pieces for rocking engagement with the ground;

seat frame means spacing and joining the curved side pieces, said seat frame means defining an operating space near the base of the furniture;

axle pivot means extending across the inner operating space and supported at respective ends by said side pieces, and handle means for rotating the axle pivot means;

eccentric mounting arm means extending from the axle pivot means in the inside operating space;

at least one elongate leg stop means pivotally mounted at one end to the end of said eccentric mounting arm means away from the axle pivot means so that both pivoting motion and translating motion are imparted to the elongate leg stop means upon rotation of the axle pivot means;

said seat frame means formed with at least one slot near the base of the seat frame means in alignment with the eccentric mounting arm means and leg stop means, said slot extending between the operating space and the outside of said seat frame means;

said leg stop means constructed and arranged with its free end extending through the slot so that rotation of the axle pivot means and extending cam means causes the leg stop means to pivot and translate for extending and retracting through the slot between a position substantially within the operating space and a position extending outside the seat frame means in contact with the ground when the rocking action furniture is in upright position; and locking means for locking the leg stop means in extended position for stopping the rocking action furniture in said upright position, said locking means comprising a flat locking shelf formed on the upward side of said leg stop means, said locking shelf formed at a substantially complementary angle to a portion of the seat frame means defining an edge of the slot whereby at least a portion of the weight of said furniture is directed through an edge of the slot onto the locking shelf locking the leg stop means in place by the weight of said furniture bearing on the locking shelf and whereby the downward force of said furniture is transmitted to the axle pivot means through the leg stop means and eccentric mounting arm means thereby locking said furniture in upright position with the leg stop means extended.

2. The action furniture of claim 1 wherein said eccentric mounting arm means comprises first and second yokes extending from the axle pivot means and further comprising first and second leg stop means pivotally mounted respectively to said first and second yokes.

3. The action furniture of claim 1 wherein said leg stop means comprises an elongate curved leg having a major curve extending concave upward so that the leg may be drawn smoothly through the slot, bearing against the edge of said slot upon rotation of the axle pivot means.

4. The action furniture of claim 3 wherein said leg stop means is provided with a slight reverse curvature at the end of the leg stop means concave downward relative to the major curve of the leg stop means thereby facilitating stable contact with the ground by the end of the leg stop means when the leg stop means is in extended position and the rocking action furniture is in upright position.

5. The rocking action furniture of claim 3 wherein said leg stop means is formed with at least one flat locking shelf on the concave upward major curve of said leg stop means, said flat shelf formed substantially at a complementary angle to a portion of the seat frame means comprising an edge of the slot whereby a portion of the weight of the furniture is directed onto said locking shelf pushing downward on the top side of said leg locking the leg in place by the weight of the chair bearing through an edge of the slot onto said locking shelf and whereby the downward force of said furniture is therefore transmitted to the axle pivot means through said eccentric mounting arm means and leg stop means thereby locking said rocking action furniture in upright position when said leg stop means is extended.

6. The rocking action furniture of claim 5 wherein said elongate leg stop means is formed with a protruding hammerhead at the top or pivotal end of said leg, said leg stop means and protruding hammerhead being constructed and arranged for bearing of said head against the seat frame means for pushing the locking shelf against the edge of one side of said slot for wedging or jamming action of the locking shelf against said edge of the slot formed through the seat frame means upon extension of the leg stop means thereby supporting the weight of said furniture and stopping said furniture in an upright position.

7. The rocking action furniture of claim 1 wherein said elongate leg stop means is formed with a protruding hammerhead at the top or pivotal end of said leg, said leg stop means and protruding hammerhead being constructed and arranged for bearing of said head against the seat frame means for pushing the locking shelf against the edge of one side of said slot for wedging or jamming action of the locking shelf against said edge of the slot formed through the seat frame means upon extension of the leg stop means thereby supporting the weight of said furniture and stopping said furniture in an upright position.

8. The rocking action furniture of claim 1 wherein sai seat frame means comprises a back panel, a seat panel substantially at right angles to said back panel and a reclining panel joining said back panel and seat panel at acute angles with panels, said panels thereby defining an inner operating space of substantially triangular cross section.

9. The rocking action furniture of claim 8 wherein said slot is formed in the seat panel adjacent the junction with said back panel and wherein the bottom of the back panel defines one edge of said slot.

10. The rocking action furniture of claim 1 wherein said curved side pieces for rocking engagement with the ground comprise a major curvature concave upward and a first minor reverse curvature concave downward at the forward end of the major curve thereby providing a forward rocking stop to prevent the furniture from falling forward and wherein said action furniture further comprises a second minor reverse curvature concave downward at the backward end of said major curve thereby providing a backward rocking stop.

11. The action furniture of claim 10 wherein said seat frame means is upholstered and includes an upholstered portion formed over the back of said seat frame means and wherein said second minor reverse curvature comprises said upholstered portion formed over the back of the seat frame means and protruding beyond said curved side pieces.

12. The action furniture of claim 1 wherein said curved side pieces for rocking engagement with the ground comprises a major curved portion in turn comprised of at least three component arcs of curvature of increasing radius from the base of the major curved portion to the top thereby providing a decreasing curvature from the base of the major curved portion to the top so that the rocking motion is damped or slowed in the backward rocking direction.

13. An upright stop mechanism for rockable furniture formed with side frame pieces comprising:

axle pivot means extending across the rockable furniture adjacent the base thereof and supported at respective ends by said side frame pieces, said axle pivot means formed with extending eccentric mounting arm means, and handle means for rotating the axle pivot means;

at least one elongate leg stop means eccentrically and pivotally mounted at one end relative to the axle pivot means on the extending eccentric mounting arm means for retracting and extending said leg stop means upon operation of the handle means rotating the axle pivot means;

slot defining means formed adjacent to the base of said rockable furniture, said slot defining means constructed and arranged to define a slot for receiving the leg stop means and guiding the leg stop means during operation of said handle means;

said leg stop means constructed and arranged with its free end extending through the slot defined by said slot defining means so that rotation of the axle pivot means by operation of said handle means causes the leg stop means to pivotally extend and retract through said slot defining means between a substantially retracted position without interference in the rocking action of the rockable furniture and an extended position for bearng against the ground when said rockable furniture is in an upright position; and locking means for locking said leg stop means in the extended position for locking said rockable furniture in an upright position, said locking means comprising a locking shelf formed near the pivotally mounted end of said leg stop means, said locking shelf complementary with the said slot defining means for bearing of said locking shelf against the edge of the slot defined by said slot defining means and for locking the leg in place by the weight of said furniture on the locking shelf.

14. The upright stop mechanism of claim 13 wherein said leg stop means comprises an elongate leg with a major curvature concave upward to facilitate extension and retraction of said elongate leg through the slot defining means and wherein said elongate leg is further formed with a minor reverse curvature concave downward formed at the lower free end of said elongate leg to facilitate stable contact of the end of said leg with the ground.

15. The upright stop mechanism of claim 14 wherein said elongate leg is further formed with a protruding hammer at the upper pivotally mounted end thereof constructed and arranged for engaging a portion of the rockable furniture and pushing the locking shelf against the complementary edge of the slot formed by said slot defining means.

16. The upright stop mechanism of claim 13 further comprising:

seat frame means spacing and joining the side frame pieces, said seat frame means defining an inner operating space near the base of the furniture;

said axle pivot means extending across the inner operating space and supported adjacent respective ends by said side frame pieces;

said slot defining means comprising said seat frame means formed with at least one slot near the base of the seat frame means in alignment with the and leg stop means, said slot extending between the inner operating space and the outside of said seat frame means.

17. The upright stop mechanism of claim 16 wherein said leg stop means comprises at least one elongate leg formed with a major smooth curve so that said leg can be drawn smoothly through the slot, bearing against the edges of said slot upon rotation of the axle pivot means, and wherein said locking means comprises a locking shelf formed in the major smooth curve of said elongate leg, said locking shelf formed substantially at a complementary angle to a portion of the seat frame means comprising an edge of the slot whereby at least a portion of the weight of said chair is directed onto the locking shelf pushing downward on said leg when the leg is extended and an edge of said slot engages the locking shelf and whereby the downward force of said furniture is transmitted to the axle pivot means through said leg thereby retaining and locking said furniture in an upright position, and wherein said leg is formed with a protruding hammer at the top or pivotally mounted end of said leg, said upright stop mechanism constructed and arranged for bearing of the protruding hammer against said seat frame means for pushing the locking shelf of said leg against an edge of the slot for supporting a portion of the weight of said furniture and locking said leg in extended position.

* * * * *